US010360844B2

(12) United States Patent
Zhou et al.

(10) Patent No.: US 10,360,844 B2
(45) Date of Patent: Jul. 23, 2019

(54) DISPLAY PANEL, METHOD FOR DISPLAYING AN IMAGE ON THE SAME, AND DISPLAY DEVICE

(71) Applicant: Shanghai Tianma AM-OLED Co., Ltd., Shanghai (CN)

(72) Inventors: Jingxiong Zhou, Shanghai (CN); Ruiyuan Zhou, Xiamen (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 74 days.

(21) Appl. No.: 15/866,389

(22) Filed: Jan. 9, 2018

(65) Prior Publication Data

US 2018/0130408 A1 May 10, 2018

(30) Foreign Application Priority Data

Jul. 20, 2017 (CN) ..... 2017 1 0597676

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2310/0218* (2013.01); *G09G 2320/064* (2013.01); *G09G 2320/0646* (2013.01)

(58) Field of Classification Search
CPC ..... G09G 3/3208; G09G 3/3225; G09G 2310/0218; G09G 2320/0646; G09G 2320/064
See application file for complete search history.

(56) References Cited

U.S. PATENT DOCUMENTS

2011/0148948 A1* 6/2011 Gandhi ..... G02B 26/001 345/690
2015/0138258 A1 5/2015 Lee et al.
2015/0348462 A1* 12/2015 Ma ..... G09G 3/3225 345/78

* cited by examiner

*Primary Examiner* — Abhishek Sarma
(74) *Attorney, Agent, or Firm* — Alston & Bird LLP

(57) ABSTRACT

Embodiments of the disclosure disclose a display panel, a method for displaying an image on the same and a display device. For the determined brightness mode, every n frames of images to be displayed are taken as a group, and when being displayed, each group of n frames of images is controlled to emit light for the same total amount of time; and when each frame of image is being displayed each row of pixels operate in the light-emitting phase for the same amount of time, so that the images can be displayed with normal brightness in this mode. When n frames of images in a group are being displayed, different light-emitting control signals are transmitted to the same row of pixels. And/or, when each frame of image in a group is being displayed, at least two of light-emitting control signals transmitted to different rows of pixels are different.

20 Claims, 13 Drawing Sheets

DISPLAY PANEL, METHOD FOR DISPLAYING AN IMAGE ON THE SAME, AND DISPLAY DEVICE

CROSS-REFERENCE TO RELATED APPLICATIONS

This application claims the priority to Chinese Patent Application No. CN201710597676.7, filed on Jul. 20, 2017, the content of which is hereby incorporated by reference in its entirety.

FIELD

The present disclosure relates to the field of display technology, and specifically to a display panel, a method for displaying an image on the same, and a display device.

BACKGROUND

Organic Light-Emitting Diode (OLED) displays have become a hot spot for flat panel display research. Compared with a Liquid Crystal Display (LCD), an OLED display has lower power consumption, a lower production cost, a wider viewing angle, a faster response speed, and is self-luminous. Among existing technologies, OLED displays have come to replace traditional LCDs in flat panel displays in mobile phones, personal digital assistant devices (PDAs) and digital cameras.

An OLED display controls light emission of pixels using a light-emitting control signal. For example, when the light-emitting control signal is at a low level, the pixels emit light, and when the light-emitting control signal is at a high level, the pixels do not emit light. It is most common to adjust a ratio of the high level of the light-emitting control signal to its low level in order to control the brightness of the display, as illustrated by FIG. 1, which is a light-emitting timing diagram corresponding to a conventional display. Within one frame, the longer the light-emitting control signals (Emit(1) to Emit(N)) stay at the low level, the higher the brightness of the display will be; and the shorter the light-emitting control signals stay at the low level, the lower the brightness of the display is. Within one frame, in order to avoid display problems resulting from pixels being bright or dark for too long, usually several pulse cycles are designed in a light-emitting control signal. In each pulse cycle, the low level represents that a corresponding row of pixels are lightened, and the high level represents that a corresponding row of pixels do not emit light. So a higher duty cycle of the low level in the light-emitting control signal leads to a longer emission of light from pixels, and accordingly a higher brightness of the display.

With the existing brightness control method, when the brightness mode is fixed, each row of pixels receive a same light-emitting control signal for a long time, that is, all the controlled pixels become bright or dark periodically and regularly. However, due to response time from hysteresis of human eyes, rolling or static bright and dark bands might be seen on the screen of the display panel, which is not desired.

SUMMARY

In view of this challenge, embodiments of the disclosure provide a display panel, a method for displaying an image on the same and a display device, to address the problem of poor display performance in prior arts.

Embodiments of the disclosure provide a method for displaying an image on a display panel. And the method includes the following operation: for a brightness mode: displaying a plurality of groups of n frames each, wherein every group has a same total light-emitting time, wherein a total light-emitting time of each group equals to a sum of light emitting time of all n frames, wherein n is an integer greater than 1; wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame of image emits light when a row of pixels operate in the light-emitting phase in within one frame; wherein when n frames of images in a group are displayed, at least two of light-emitting control signals transmitted to a same row of pixels are different.

Correspondingly an embodiment of the disclosure further provides a display panel. The display panel displays an image using a method including the following operations. For a brightness mode: displaying a plurality of groups of n frames each, wherein every group has a same total light-emitting time, wherein a total light-emitting time of each group equals to a sum of light emitting time of all n frames, wherein n is an integer greater than 1; wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame of image emits light when a row of pixels operate in the light-emitting phase in within one frame; wherein when n frames of images in a group are displayed, at least two of light-emitting control signals transmitted to a same row of pixels are different.

Correspondingly an embodiment of the disclosure further provides a display device including a display panel displaying an image on the display panel using a method including the following operations. For for a brightness mode: displaying a plurality of groups of n frames each, wherein every group has a same total light-emitting time, wherein a total light-emitting time of each group equals to a sum of light emitting time of all n frames, wherein n is an integer greater than 1; wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame of image emits light when a row of pixels operate in the light-emitting phase in within one frame; wherein when n frames of images in a group are displayed, at least two of light-emitting control signals transmitted to a same row of pixels are different.

Advantageous effects of the disclosure are as follows.

In the display panel, the method for displaying an image on the same and the display device according to the embodiments of the disclosure, for the determined brightness mode, every n frames of images to be displayed are taken as a group, and when being displayed, each group of n frames of images is controlled to emit light for the same total amount of time; and when each frame of image is being displayed each row of pixels operate in the light-emitting phase for the same amount of time, so that the images can be displayed with normal brightness in this mode. When n frames of images in a group are displayed, at least two of light-emitting control signals transmitted to different rows of pixels are different. When each frame of image in a group is being displayed, different light-emitting control signals are transmitted to different rows of pixels. Different from prior arts in which same light-emitting control signals are used for one row or for different rows of pixels when displaying different frames of images, the embodiments of the disclosure makes cycles of high and low levels of light-emitting control signals random and solves the problems of poor display performance of existing display panels, such as the existence of bright and dark bands.

DETAILED DESCRIPTION OF THE EMBODIMENTS

Figure 1:
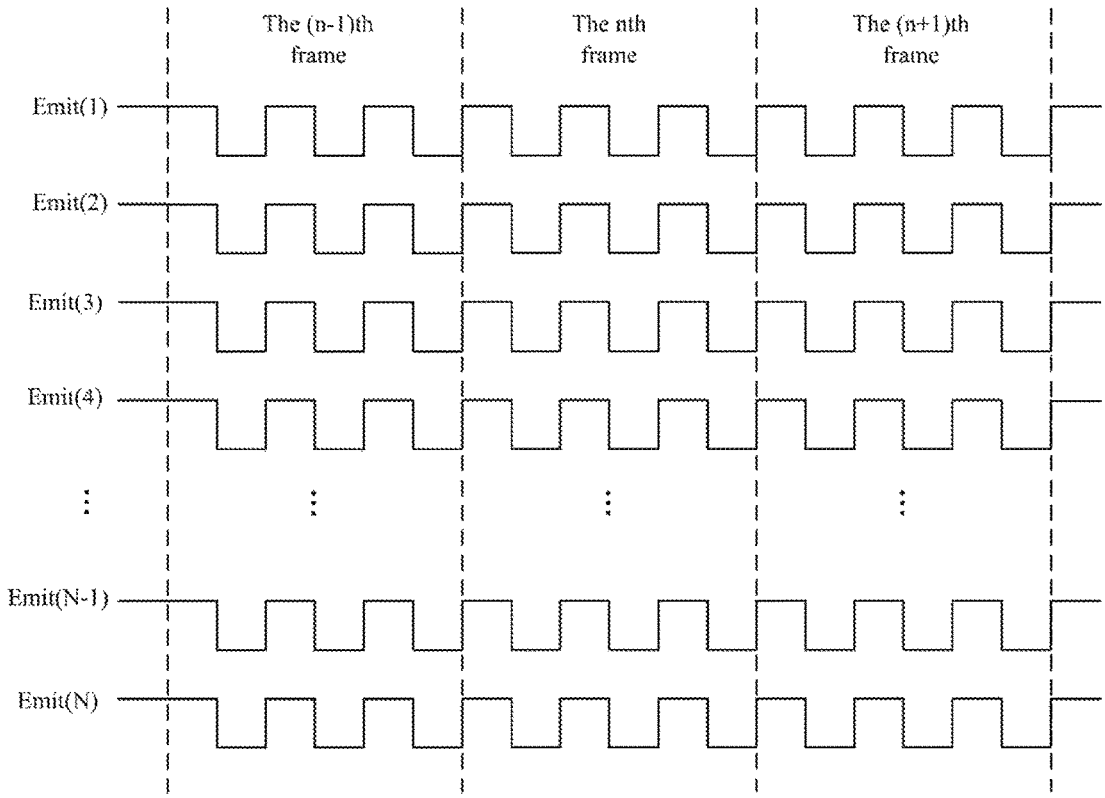
FIG. 1 is a light-emitting timing diagram corresponding to a current display.

In order to achieve the purpose, technical solutions, and advantages of the embodiments of the disclosure clearer, the disclosure is described below in details with reference to the drawings. Apparently the embodiments described below are only a part but not all of the embodiments of the disclosure. Based upon the embodiments disclosed herein, all the other embodiments which can occur to those skilled in the art without any inventive effort shall fall into the scope of the disclosure.

Shapes and sizes of each component illustrated by the drawings do not reflect real proportions, and are only intended to illustrate the content of the disclosure.

A method for displaying an image on a display panel according to embodiments of the disclosure includes the following operations. For a determined brightness mode, taking n frames of images to be displayed as a group, and controlling each group of n frames of images being displayed to emit light for a same total amount of time; where the total amount of time, during which then frames of images emit light, is the sum of time during which each of the n frames of images emits light, herein n is any integer greater than 1. When displaying each frame of image to be displayed, transmitting a light-emitting control signal having at least one cycle to each row of pixels of the display panel, so that each row of pixels operate in a light-emitting phase for a same amount of time, where the pulse cycle includes the light-emitting phase and a closing phase, and a frame of image emits light when a row of pixels operate in the light-emitting phase within one frame. When n frames of images in a group are all displayed, at least two of light-emitting control signals transmitted to a same row of pixels are different. And/or, when each frame of image in a group is displayed, at least two of light-emitting control signals transmitted to different rows of pixels are different.

In the method for displaying an image on a display panel according to embodiments of the disclosure, for the determined brightness mode, n frames of images to be displayed are taken as a group, and when being displayed, each group of n frames of images is controlled to emit light for the same total amount of time; and when each frame of image is being displayed each row of pixels operate in the light-emitting phase for the same amount of time, so that the images can be displayed with normal brightness in this mode. When n frames of images in a group are being displayed, different light-emitting control signals are transmitted to the same row of pixels. And/or, when each frame of image in a group is being displayed, at least two of light-emitting control signals transmitted to different rows of pixels are different. Different from the prior art in which same light-emitting control signals are used for each row of pixels when displaying different frames of images, and/or, in which a same light-emitting control signal is used for different rows of pixels, embodiments of the disclosure makes cycles of high and low levels of light-emitting control signals random and solves the problems of poor display performance of existing display panels, such as the existence of bright and dark bands.

Specifically in the method for displaying an image on a display panel according to embodiments of the disclosure, when a brightness mode is determined, each group of images displayed in the brightness mode emit light for a same total amount of time. When two groups of images are displayed in different brightness modes, the two groups of images emit light for different total amounts of time.

Specifically in the method for displaying an image on a display panel according to embodiments of the disclosure, within one frame, the amount of time during which a row of pixels operate in the light-emitting phase equals to the amount of time during which a light-emitting control signal transmitted to the row of pixels is in the light-emitting phase. For example, a light-emitting control signal transmitted to a row of pixels within one frame has three pulse cycles, a light-emitting phase in a first pulse cycle lasts 0.1 seconds, a light-emitting phase in a second pulse cycle lasts 0.2 seconds, and a light-emitting phase in a third pulse cycle lasts 0.15 seconds, then the amount of time during which the row of pixels operate in the light-emitting phases is 0.1+0.2+0.15=0.45 seconds.

Specifically, in order to prevent poor display performance resulted from periodical high and low levels of a light-emitting control signal in a determined brightness mode, in the method for displaying an image on a display panel according to embodiments of the disclosure, in the brightness mode, each row of pixels operate in the light-emitting phase for a same amount of time within one frame, but at least two different light-emitting control signals are transmitted to a same row of pixels across multiple different frames of images, or different light-emitting control signals are transmitted to different rows of pixels within one frame.

The disclosure is described below in details in connection with specific embodiments thereof. It is noteworthy that these the embodiments are intended to better explain the disclosure, but not to limit the disclosure thereto. Furthermore, for the sake of convenience, in all the embodiments below, n is 3, a light-emitting control signal is at a low level in the light-emitting phase, and the duty cycle of total light-emitting time of a group of images is 50% by way of an example.

First Embodiment

Figure 2:
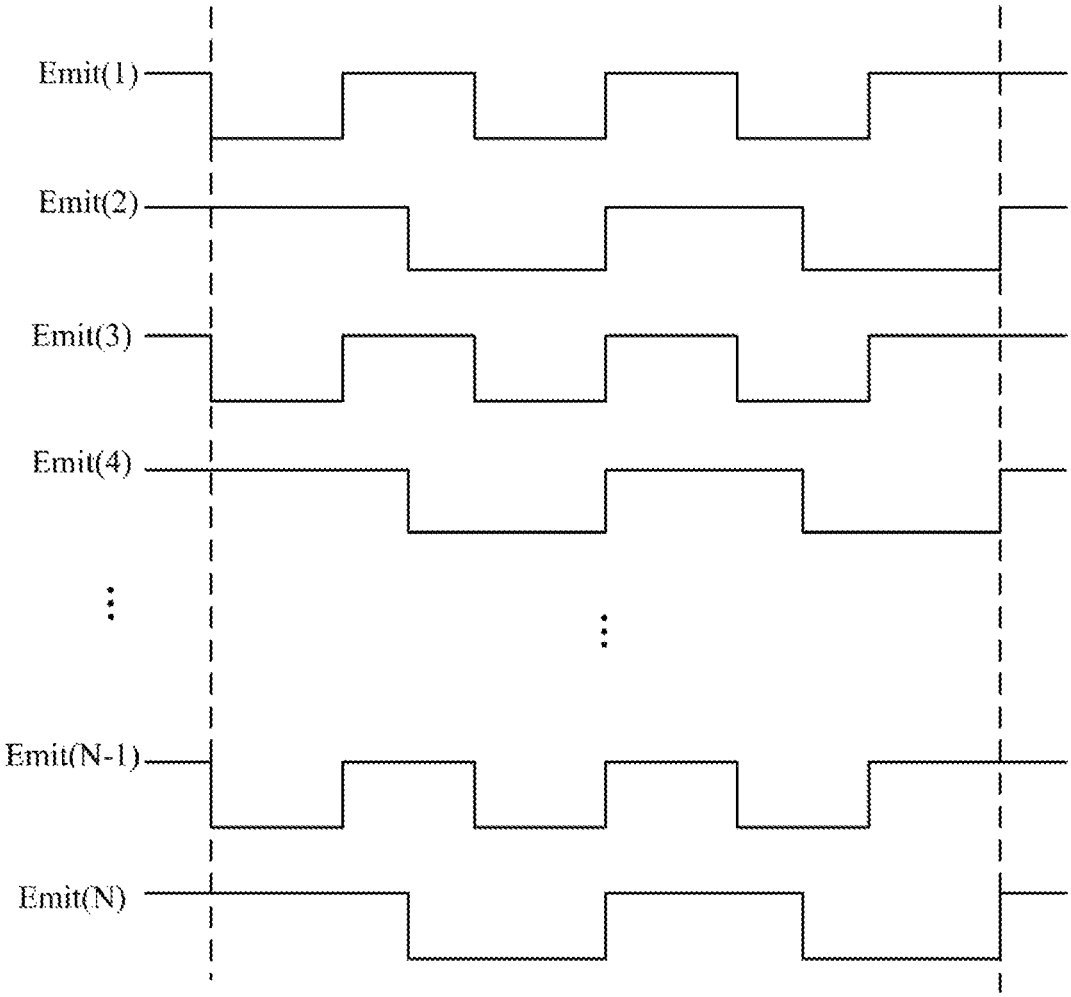
FIG. 2 is a timing diagram corresponding to a method for displaying an image on a display panel according to an embodiment of the disclosure.

Specifically, in a method for displaying an image on a display panel according to the first embodiment of the disclosure, in order to avoid poor display performance effectively, as illustrated by FIG. 2, a timing diagram corresponding to the method is provided.

For a determined brightness mode, n frames of images to be displayed are taken as a group, and each group of n frames of images being displayed are controlled to emit light for a same amount of time. When each frame of image in a group is displayed, at least two different light-emitting control signals Emit(k) are transmitted to different rows of pixels. FIG. 2 illustrates one frame of image by way of an example.

It is noteworthy that in the disclosure, Emit(k) refers to a light-emitting control signal transmitted to the k-th row of pixels, where k=1, 2, . . . , N, and N represents the total number of rows of pixels of the display panel.

Specifically, in the method according to the first embodiment of the disclosure, a high-potential signal and a low-potential signal alternating in a light-emitting control signal constitute a pulse cycle. The duty cycle of a pulse cycle refers to a proportion of a light-emitting phase in a duty cycle's time. In FIG. 2, for example, Emit(1) has three pulse cycles. Suppose a light-emitting phase occurs when the light-emitting control signal is low-potential in a pulse cycle, and the duty cycle of each pulse cycle in Emit(1) is 50%. Emit(2) has two pulse cycles and the duty cycle of each pulse cycle is 50%.

Optionally in the method according to the first embodiment of the disclosure, when each frame of image is displayed, at least two different light-emitting control signals are transmitted to different rows of pixels in the following specific way.

At least two of the light-emitting control signals transmitted to different rows of pixels have different numbers of pulse cycles.

Optionally in the method according to the first embodiment of the disclosure, when each frame of image is displayed, at least two of the light-emitting control signals transmitted to different rows of pixels having different numbers of pulse cycles, could be specifically implemented in the following way, as illustrated in FIG. 2.

For each frame of image in a same group, light-emitting control signals (Emit(1), Emit(3), and . . . ) transmitted to all the odd rows of pixels have a same number of pulse cycles; and light-emitting control signals (Emit(2), Emit(4), and . . . ) transmitted to all the even rows of pixels have a same number of pulse cycles. The number of pulse cycles in a light-emitting control signal (Emit(1), Emit(3), or . . . ) transmitted to an odd row of pixels is different from the number of pulse cycles in a light-emitting control signal (Emit(2), Emit(4), or . . . ) transmitted to an even row of pixels.

In FIG. 2, for example, when a frame of image is displayed, light-emitting control signals (Emit(1), Emit(3), and . . . ) transmitted to all the odd rows of pixels each include three pulse cycles. Light-emitting control signals (Emit(2), Emit(4), and . . . ) transmitted to all the even rows of pixels each include 2 pulse cycles. In this way, the different light-emitting control signals can be transmitted to the odd rows of pixels and the even rows of pixels through two light-emitting control circuits.

Specifically, in the method according to the first embodiment for each frame of image, at least two different light-emitting control signals are transmitted to different rows of pixels, as opposed to the prior art where a same light-emitting control signal is used for different rows of pixels, thus making cycles of high and low levels of the light-emitting control signals random and solving the problems of poor display performance of existing display panels, such as the existence of bright and dark bands.

Second Embodiment

Figure 3:
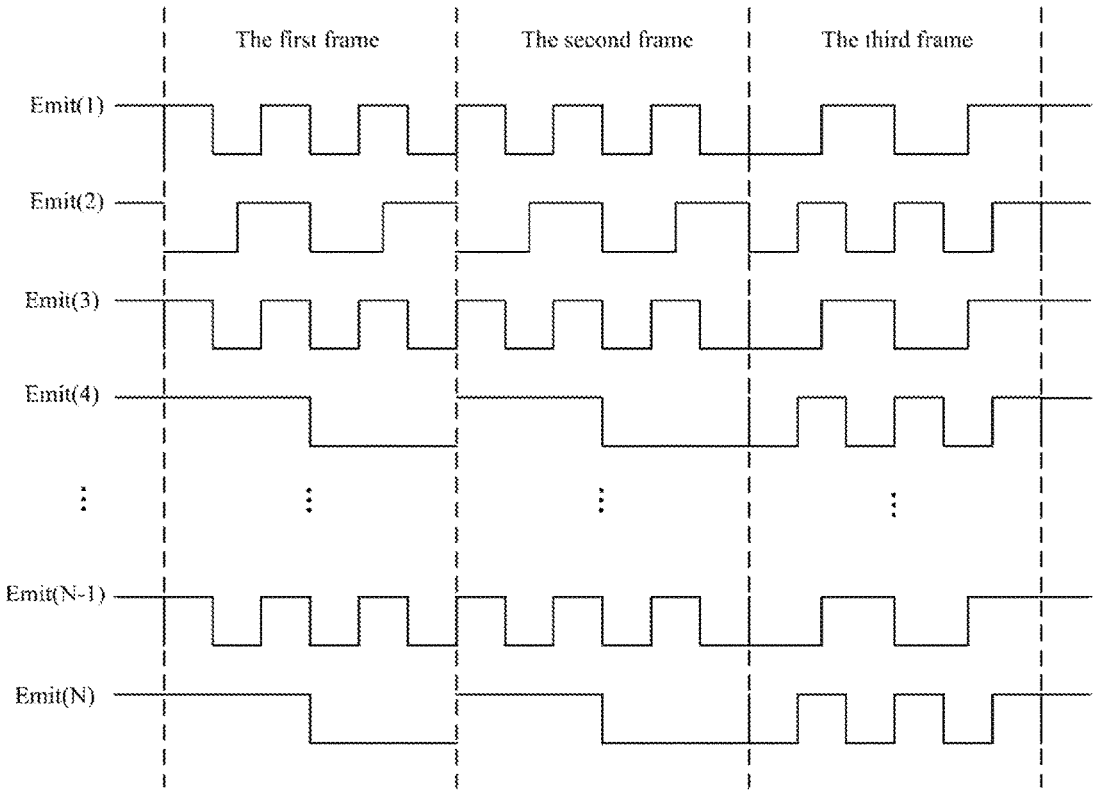
FIG. 3 is a timing diagram corresponding to a method for displaying an image on a display panel according to an embodiment of the disclosure.

Specifically, as illustrated in FIG. 3, a timing diagram corresponding to another method for displaying an image on a display panel according to the second embodiment of the disclosure is provided. When different frames of images in a same group are displayed, light-emitting control signals Emit(k) transmitted to a same row of pixels are in the light-emitting phase for a same amount of time. When each frame of image in a group is displayed, at least two of light-emitting control signals Emit(1) to Emit(N) transmitted to different rows of pixels are different.

In other words, in the method according to the second embodiment of the disclosure, each of n frames of images in a group emits light for a same amount of time, but when each frame is displayed, at least two light-emitting control signals transmitted to different rows of pixels are different.

Specifically, in the method according to the second embodiment of the disclosure as illustrated in FIG. 3, when different frames of images in a same group are displayed, at least two of light-emitting control signals Emit(k) transmitted to a same row of pixels are different in order to avoid poor display performance. Specifically, taking the first row of pixels as an example, light-emitting control signals Emit (1) transmitted to the first row of pixels may be different for any two of n frames of images in a group, or may be different only for a part of the n frames of images, although the embodiment of the disclosure is not be limited thereto. In FIG. 3, for example, light-emitting control signals Emit(1) transmitted to the first row of pixels are the same for both the first frame of image and the second frame of image, but are different for the third frame of image and the second frame of image.

Figure 4:
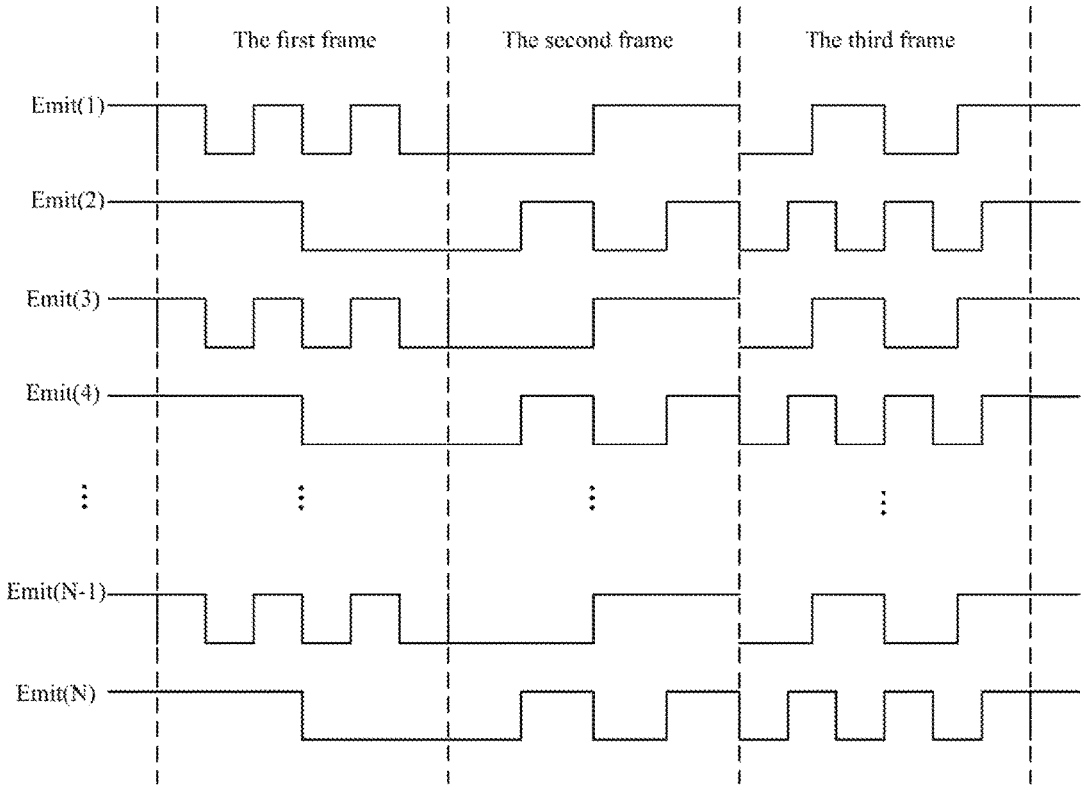
FIG. 4 is a timing diagram corresponding to another method for displaying an image on a display panel according to an embodiment of the disclosure.

Optionally according to the second embodiment of the disclosure as illustrated in FIG. 4 showing a timing diagram for displaying an image on a display panel, when any two adjacent frames of images in a same group are displayed, light-emitting control signals Emit(k) transmitted to a same row of pixels are different to avoid poor display performance.

Specifically when any two adjacent frames of images in a same group are displayed, the numbers of pulse cycles included in light-emitting control signals Emit(k) transmitted to a same row of pixels are different, but each pulse cycle' duty cycle is the same, thus facilitating generation of the light-emitting control signals.

Specifically taking the first row of pixels in FIG. 4 as an example, when a first frame of image is displayed, a light-emitting control signal Emit(1) transmitted to the first row of pixels includes three pulse cycles whose duty cycles are 50%, when a second frame of image is displayed, Emit(1) includes 1 pulse cycle whose duty cycle is 50%, and when a third frame of image is displayed, Emit(1) includes 2 pulse cycles whose duty cycle are also 50%.

Specifically in the method according to the second embodiment of the disclosure, for each frame of image in a same group, as illustrated in FIG. 4, light-emitting control signals (Emit(1), Emit(3), and . . . ) transmitted to all the odd rows of pixels have a same number of pulse cycles. Light-emitting control signals (Emit(2), Emit(4), and . . . ) transmitted to all the even rows of pixels have a same number of pulse cycles. The number of pulse cycles in a light-emitting control signal (Emit(1), Emit(3), or . . . ) transmitted to an odd rows of pixels is different from the number of pulse cycles in a light-emitting control signal (Emit(2), Emit(4), or . . . ) transmitted to an even rows of pixels. In FIG. 4, for example, for the first frame of image, each of the light-emitting control signals (Emit(1), Emit(3), and . . . ) transmitted to all the odd rows of pixels has three pulse cycles, and each of the light-emitting control signals (Emit(2), Emit(4), and . . . ) transmitted to all the even rows of pixels has one pulse cycle.

Specifically the method according to the second embodiment of the disclosure is as opposed to a conventional display where light-emitting control signals of each row of pixels are consistent across different frames of images, and where light-emitting control signals of different rows of pixels are consistent, which results in a random cycle of high and low levels of a light-emitting control signal. This embodiment addresses the problems of poor display performance of existing display panels, such as the existence of bright and dark bands.

Third Embodiment

Figure 5:
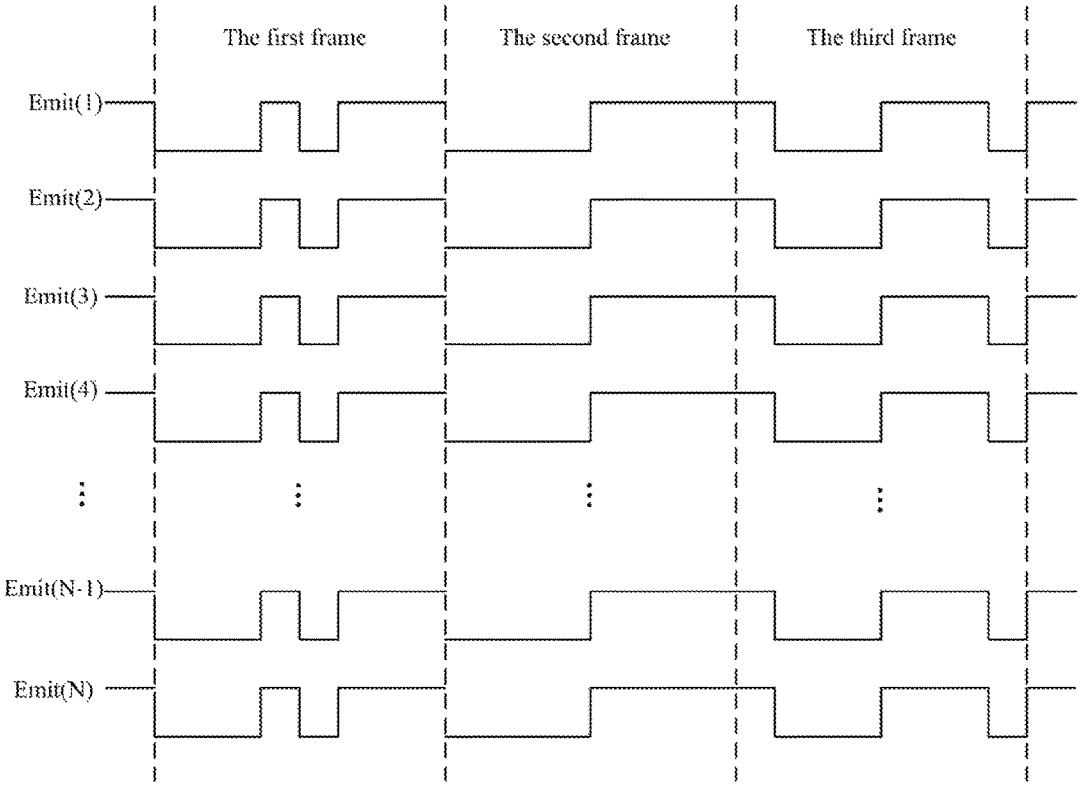
FIG. 5 is a timing diagram corresponding to another method for displaying an image on a display panel according to an embodiment of the disclosure.

Specifically, as illustrated in FIG. 5 a timing diagram corresponding to a method for displaying an image on a display panel according to the third embodiment of the disclosure is provides. When different frames of images in a same group are displayed, light-emitting control signals Emit(k) transmitted to a same row of pixels are in the light-emitting phase for a same amount of time. When any two adjacent frames of images in a same group are displayed, light-emitting control signals Emit(k) transmitted to a same row of pixels for at least one of the two adjacent frames have at least two pulse cycles where duty cycles of at least two of the pulse cycles are different.

Taking the first row of pixels in FIG. 5 as an example, when the first frame of image is displayed, a light-emitting control signal Emit(1) transmitted to the first row of pixels includes two pulse cycles, where the duty cycle of the first pulse cycle is 75%, the duty cycle of the second pulse cycle is 25%, and the proportion of the amount of time during which Emit(1) is in the light-emitting phase is 50%. When the second frame of image is displayed, Emit(1) has one pulse cycle, where the duty cycle of the pulse cycle is 50% and the proportion of the amount of time during which Emit(1) is in the light-emitting phase is 50%. When the third frame of image is displayed, Emit (1) has two pulse cycles, where the duty cycle of the first pulse cycle is 75%, the duty cycle of the second pulse cycle is 25%, and the proportion of the amount of time during which Emit(1) is in the light-emitting phase is 50%.

Figure 6:
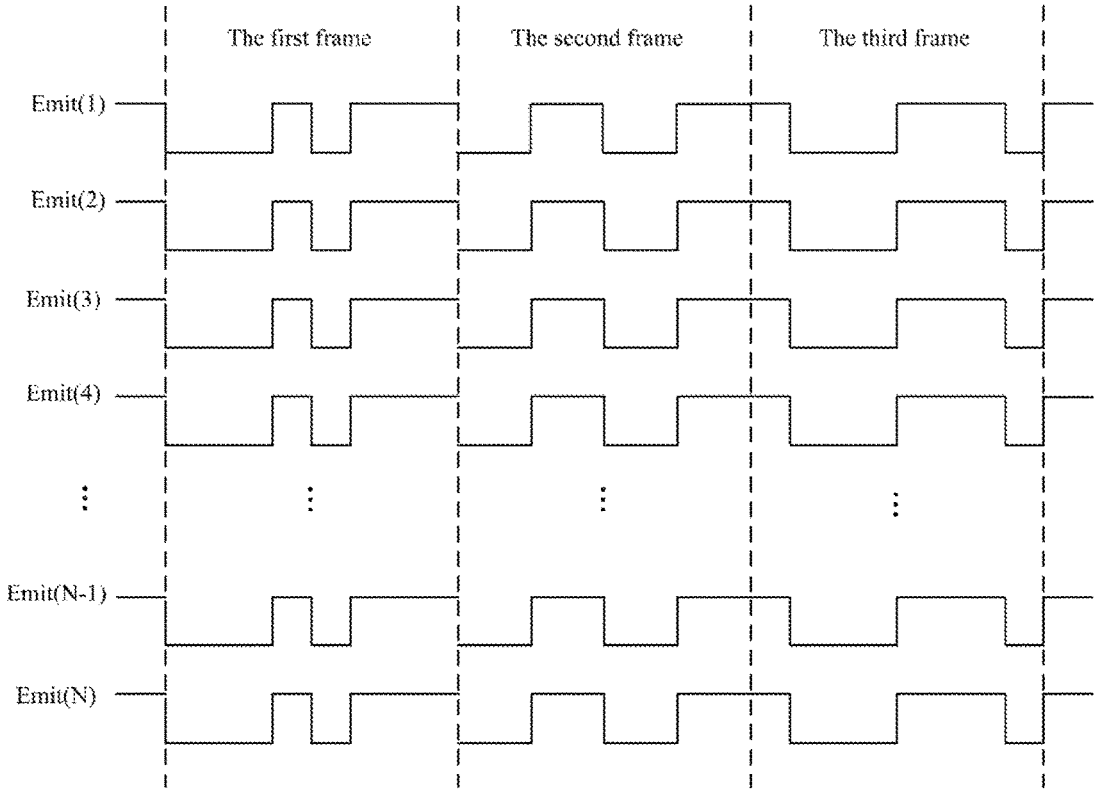
FIG. 6 is a timing diagram corresponding to another method for displaying an image on a display panel according to an embodiment of the disclosure.

Optionally, as illustrated in FIG. 6, a timing diagram corresponding to a method for displaying an image on a display panel according to the third embodiment of the disclosure is provided. When any two adjacent frames of images in a same group are displayed, the numbers of pulse cycles included in light-emitting control signals Emit(k) transmitted to a same row of pixels are the same, thus facilitating generation of the light-emitting control signals.

Of course, in the method according to the third embodiment of the disclosure, when any two adjacent frames of images in a same group are displayed, the number of pulse cycles included by light-emitting control signals transmitted to a same row of pixels might also be different and embodiments of the disclosure is not limited thereto.

Optionally in the methods according to the third embodiment of the disclosure, as illustrated in FIG. 5 and FIG. 6, for each frame of image, light-emitting control signals Emit(1) to Emit(N) transmitted to each row of pixels are the same so that only one control circuit is required.

Specifically, the method according to the third embodiment of the disclosure is as opposed to the prior art where light-emitting control signal of each row of pixels are consistent across different frames of images, thus resulting in a random cycle of high and low levels of the light-emitting control signal so as to address the problems of poor display performance of existing display panels, such as the existence of bright and dark bands.

Fourth Embodiment

Further to any one of the methods according to the third embodiment of the disclosure, for each frame of image, at least two of the light-emitting control signals transmitted to different rows of pixels may alternatively be different.

Figure 7:
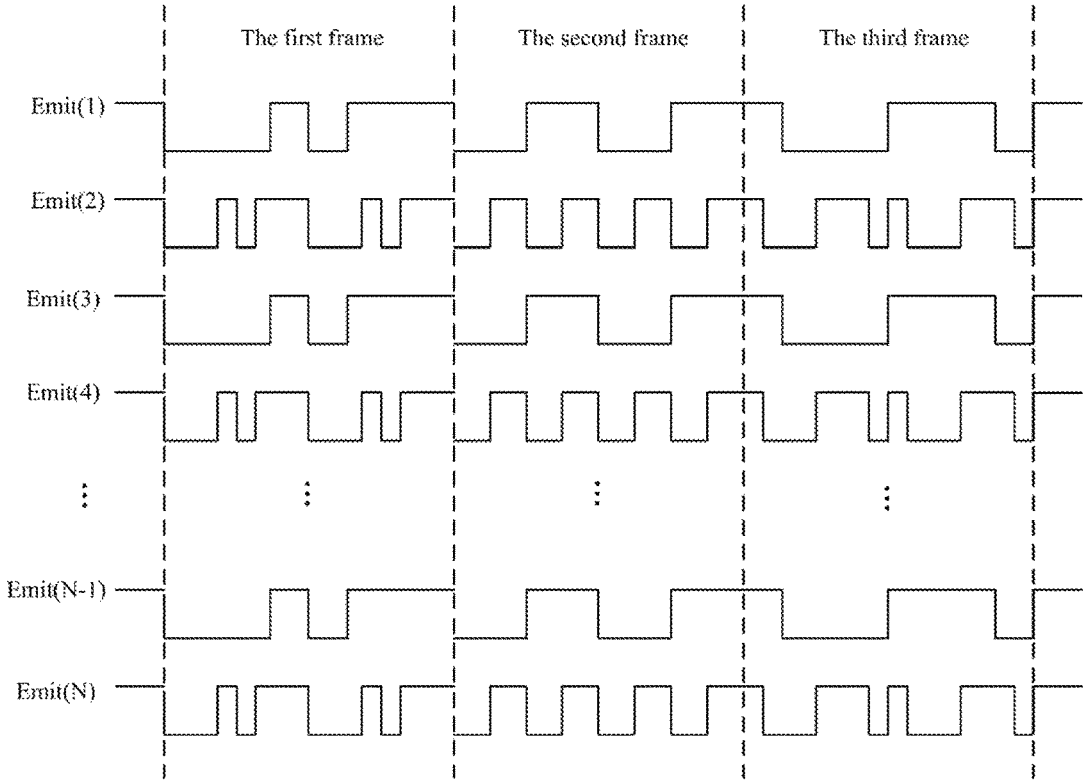
FIG. 7 is a timing diagram corresponding to another method for displaying an image on a display panel according to an embodiment of the disclosure.

Specifically, as illustrated in FIG. 7, a timing diagram corresponding to a method for displaying an image on a display panel according to the fourth embodiment of the disclosure is provided. For each frame of image, light-emitting control signals (Emit(1), Emit(3), and . . . ) transmitted to all the odd rows of pixels have a same number of pulse cycles, and light-emitting control signals (Emit(2), Emit(4), and . . . ) transmitted to all the even rows of pixels have a same number of pulse cycles. The number of pulse cycles in a light-emitting control signal (Emit(1), Emit(3), or . . . ) transmitted to an odd row of pixels is different from the number of pulse cycles in a light-emitting control signal (Emit(2), Emit(4), or . . . ) transmitted to an even row of pixels. Taking the first frame of image in FIG. 7 as an example, each of the light-emitting control signals (Emit(1), Emit(3), and . . . ) transmitted to all the odd rows of pixels has 2 pulse cycles, and each of the light-emitting control signals (Emit(2), Emit(4), and . . . ) transmitted to all the even rows of pixels has four pulse cycles. In this way, different light-emitting control signals can be transmitted to the odd rows of pixels and to the even rows of pixels using two light-emitting control circuits.

Specifically, the method according to the fourth embodiment of the disclosure is as opposed to a conventional method in which light-emitting control signals of each row of pixels are consistent across the different frames of images, and in which light-emitting control signals of different rows of pixels are consistent, thus resulting in a random cycle of high and low levels of the light-emitting control signal so as to address the problems of poor display performance of existing display panels, such as the existence of bright and dark bands.

Fifth Embodiment

Figure 8:
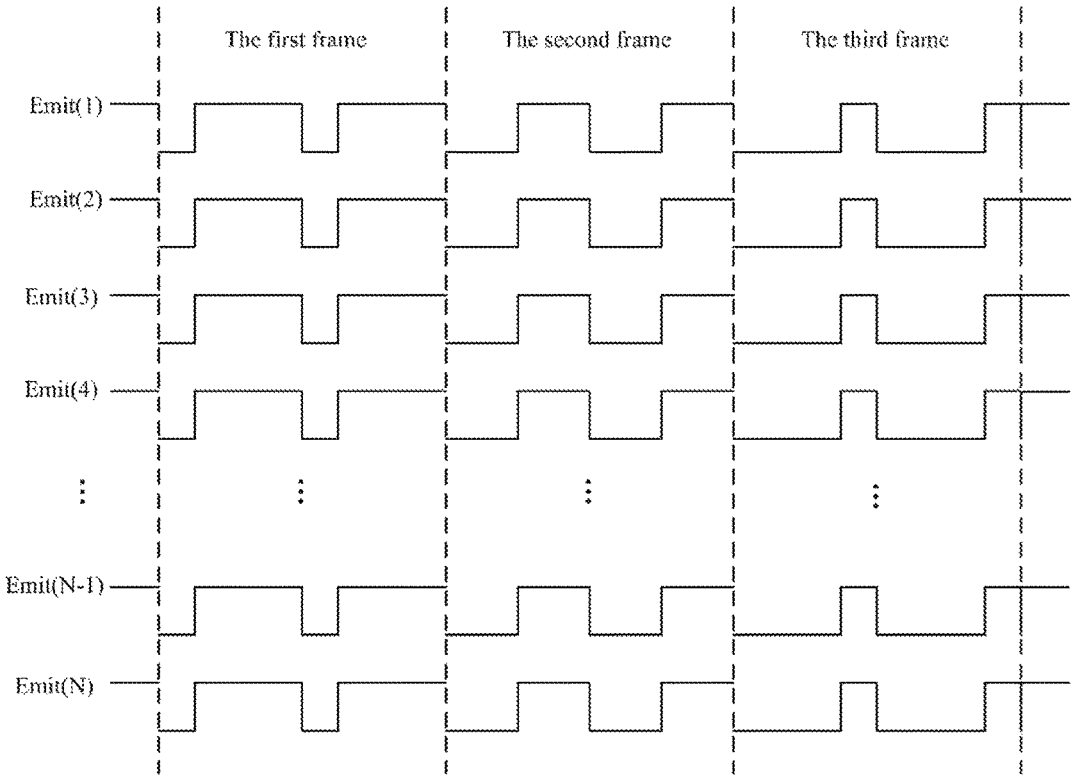
FIG. 8 is a timing diagram corresponding to another method for displaying an image on a display panel according to an embodiment of the disclosure.

Specifically, as illustrated in FIG. 8, a timing diagram corresponding to a method for displaying an image on a display panel according to the fifth embodiment of the disclosure is provided. When different frames of images in a same group are displayed, at least two of light-emitting control signals Emit(k) transmitted to a same row of pixels are in the light-emitting phase for different amount of time. In FIG. 8, for example, when the first frame of image is displayed, a light-emitting control signal Emit(1) transmitted to the first row of pixels is in the light-emitting phase for a period of time accounting for 25% within one frame, 50% when the second frame of image is displayed, and 75% when the third frame of image is displayed, where the total amount of time during which the group of frames of images emit light accounts for 50% within the group of frames. Although each frame of image in the group emit light for different amount of time, due to response time and hysteresis of human eyes, human eyes sense that the amount of time during which the three frames of images emit light accounts for an average of 25%, 50% and 75%, i.e. 50%, within the three frames.

Specifically, in the method according to the fifth embodiment of the disclosure, as illustrated in FIG. 8, when any two adjacent frames of images in a same group are displayed, light-emitting control signals Emit(k) transmitted to a same row of pixels are in the light-emitting phase for different amounts of time, In this way, cycles of high and low levels are changed after one frame and the problems of poor display performance are avoided effectively.

Specifically, in the method according to the fifth embodiment of the disclosure, as illustrated in FIG. 8, when any two adjacent frames of images in a same group are displayed, between light-emitting control signals Emit(k) transmitted to a same row of pixels, duty cycles of pulse cycles in a light-emitting control signal Emit(k) for either frame are the same, while duty cycles of pulse cycles in light-emitting control signals Emit(k) for different frames are different. In FIG. 8, for example, in the light-emitting control signal Emit(1) transmitted to the first row of pixels, duty cycles of pulse cycles when the first frame is displayed are 25%, duty cycles of pulse cycles when the second frame is displayed are 50%, duty cycles of pulse cycles when the third frame is displayed are 75%. Hence light-emitting control signals of each row of pixels vary between a high level and a low level regularly within one frame making it easy to generate the light-emitting control signals.

Specifically, in the method according to the fifth embodiment of the disclosure, as illustrated in FIG. 8, when any two adjacent frames of images in a same group are displayed, light-emitting control signals Emit(k) transmitted to a same row of pixels have a same number of pulse cycles, making it easy to generate the light-emitting control signals.

Figure 9:
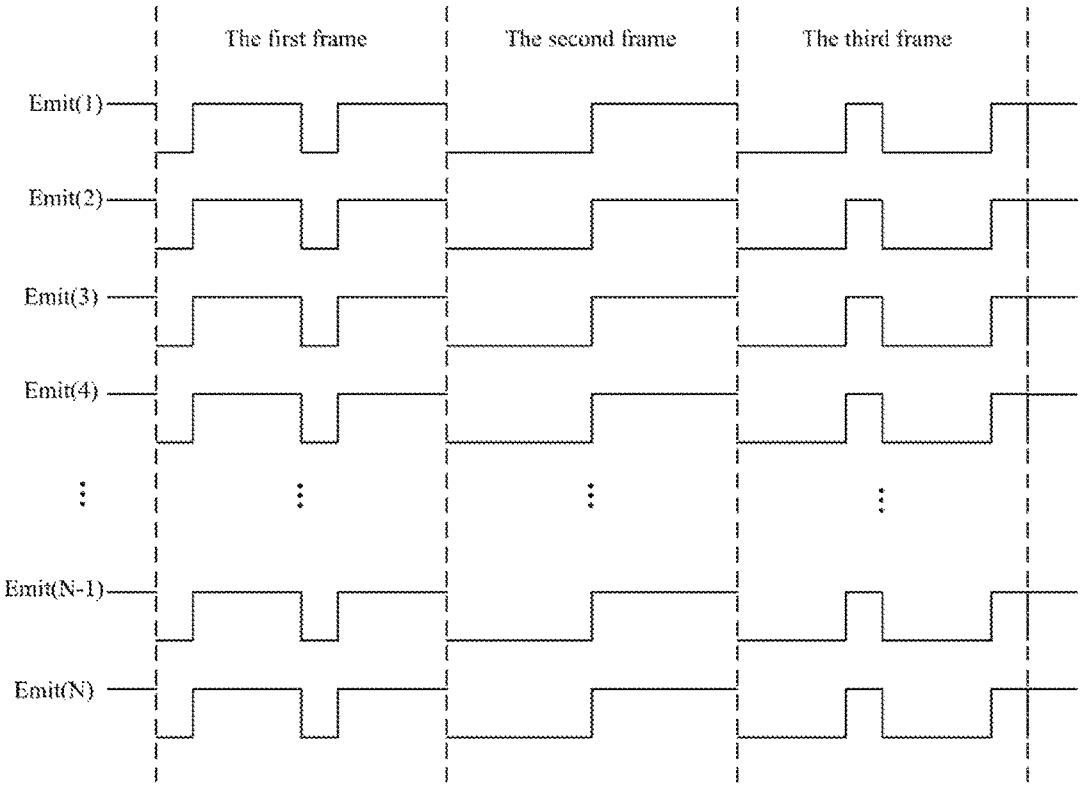
FIG. 9 is a timing diagram corresponding to another method for displaying an image on a display panel according to an embodiment of the disclosure.

Of course, as illustrated in FIG. 9, a timing diagram corresponding to a method for displaying an image on a display panel according to the fifth embodiment of the disclosure can be provided. When any two adjacent frames of images in a same group are displayed, light-emitting control signals Emit(k) transmitted to a same row of pixels may have different numbers of pulse cycles as well, although the embodiment of the disclosure is not limited thereto.

Figure 10:
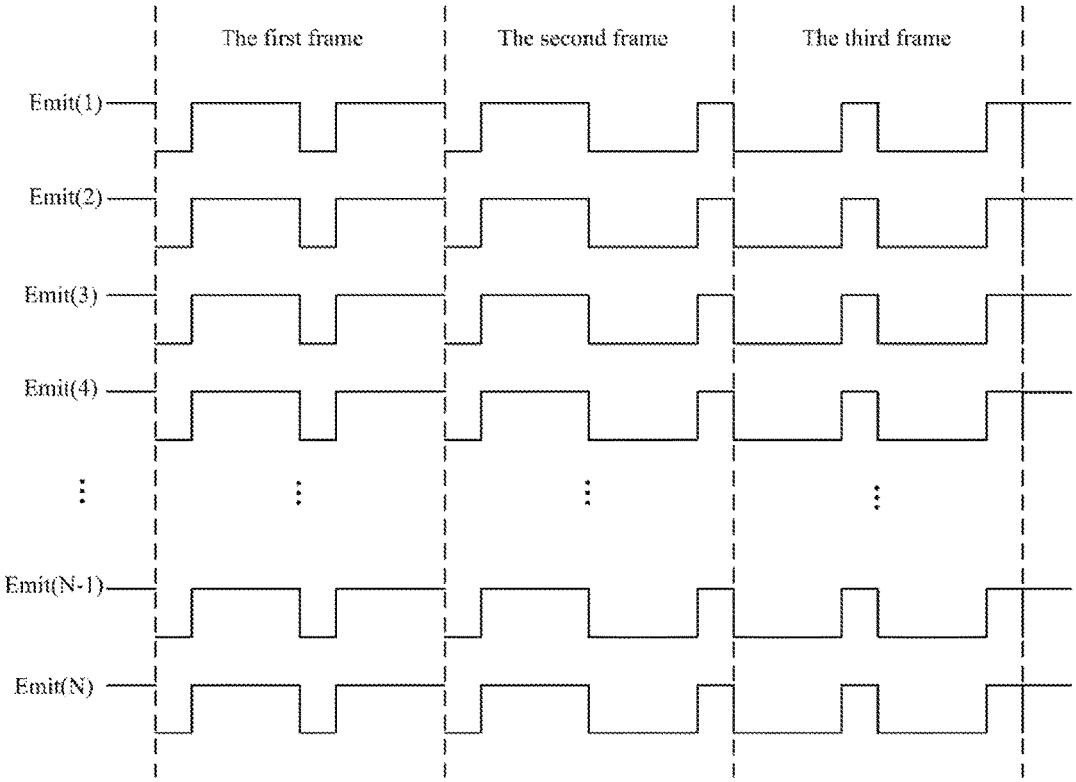
FIG. 10 is a timing diagram corresponding to another method for displaying an image on a display panel according to an embodiment of the disclosure.

Specifically, as illustrated in FIG. 10, a timing diagram corresponding to a method for displaying an image on a display panel according to the fifth embodiment of the disclosure is provided. When a frame of image in a group is displayed, light-emitting control signals Emit(k) transmitted to at least part of the rows of pixels include at least two pulse cycles, where duty cycles of at least two of the pulse cycles are different. In FIG. 10, for example, light-emitting control signals Emit(k) transmitted to each row of pixels are in the light-emitting phase for a period of time accounting for 50% of one frame's displaying time, but a light-emitting control signal Emit(k) transmitted to a row of pixels includes two pulse cycles, where the duty cycle of the first pulse cycle is 25%, and the duty cycle of the second pulse cycle is 75%.

Optionally in the methods according to the sixth embodiment of the disclosure, as illustrated in FIG. 8 to FIG. 10, for example, when each frame of image in a group is displayed, a same light-emitting control signal Emit(k) is transmitted to different rows of pixels, so that only one control circuit is required.

Specifically the methods according to the fifth embodiment of the disclosure are as opposed to the prior art in which light-emitting control signals of each row of pixels are consistent across different frames of images, thus resulting in a random cycle of high and low levels in the light-emitting control signal so as to address the problems of poor display performance of existing display panels, such as the existence of bright and dark bands.

Sixth Embodiment

Further to any one of the methods according to the fifth embodiment of the disclosure, for each frame of image, at least two of light-emitting control signals transmitted to different rows of pixels may be different.

Figure 11:
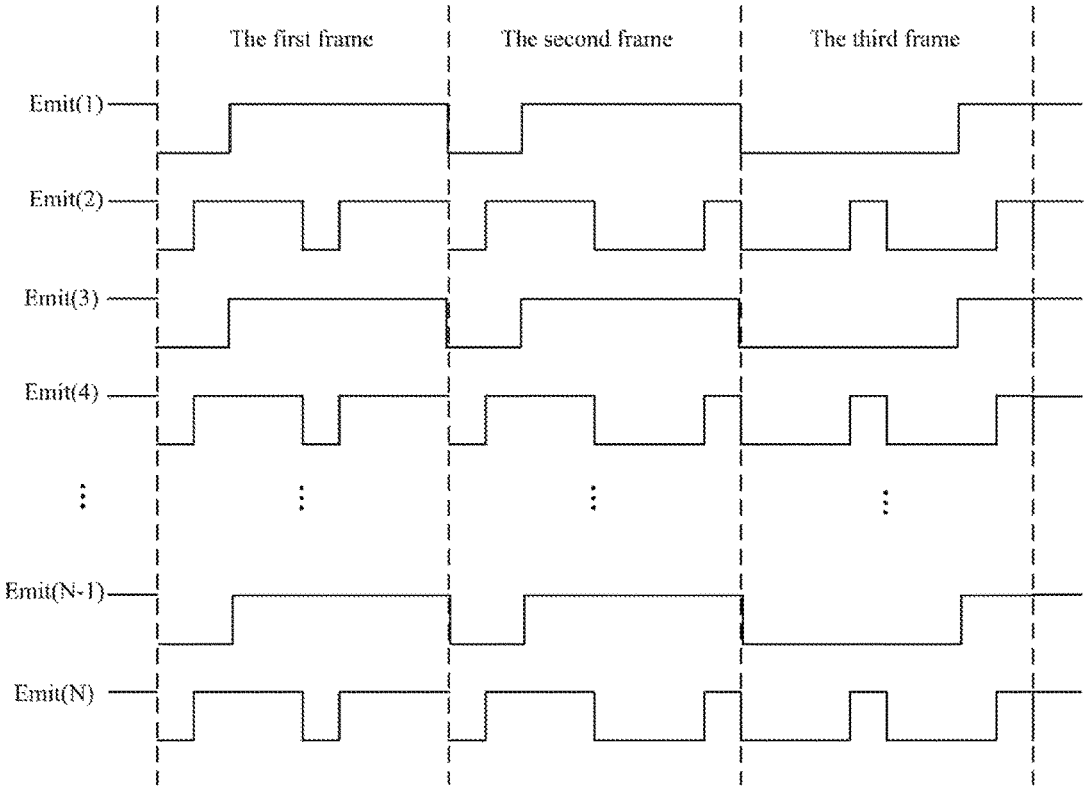
FIG. 11 is a timing diagram corresponding to another method for displaying an image on a display panel according to an embodiment of the disclosure.

Specifically, as illustrated in FIG. 11 a timing diagram corresponding to a method for displaying an image on a display panel according to the sixth embodiment of the disclosure is provided. When each frame of image is displayed, there is a same number of pulse cycles in the light-emitting control signals (Emit(1), Emit(3), and . . . ) transmitted to all the odd rows of pixels, and there is a same number of pulse cycles in the light-emitting control signals (Emit(2), Emit(4), and . . . ) transmitted to all the even rows of pixels. The number of pulse cycles in a light-emitting control signal (Emit(1), Emit(3), or . . . ) transmitted to an odd rows of pixels is different from the number of pulse cycles in a light-emitting control signal (Emit(2), Emit(4), or . . . ) transmitted to an even row of pixels. Taking the first frame of image in FIG. 11 as an example, there is one pulse cycle in each of the light-emitting control signals (Emit(1), Emit(3), and . . . ) transmitted to all the odd rows of pixels, and two pulse cycles in each of the light-emitting control signals (Emit(2), Emit(4), . . . ) transmitted to all the even rows of pixels. So that the different light-emitting control signals can be transmitted to the odd rows of pixels and the even rows of pixels using two light-emitting control circuits.

Specifically the method according to the sixth embodiment of the disclosure is as opposed to the prior art in which the light-emitting control signal of each row of pixels is consistent across the different frames of images, and in which the light-emitting control signals of the different rows of pixels are consistent, thus resulting in a random cycle of high and low levels in the light-emitting control signal so as to address the problems of poor display performance of existing display panels, such as the existence of bright and dark bands.

It is noteworthy that in the methods according to the embodiments of the disclosure, for a determined brightness mode, n frames of images in each group can be displayed using any one of the methods according to the first to sixth embodiments above. Different groups of images may be displayed using a same or different methods.

Optionally, in the methods according to the embodiments of the disclosure, for a determined brightness mode, different groups of images are displayed using a same method so that light-emitting control signals could be generated in a same pattern across different groups of images.

Based upon the same inventive idea, an embodiment of the disclosure further provides a display panel displaying an image using the method according to any one of the embodiments above of the disclosure. Since the display panel addresses the problems under a principle similar to that of the method above, reference can be made to the method above for an implementation of the display panel, and a repeated description thereof is omitted here.

Figure 12:
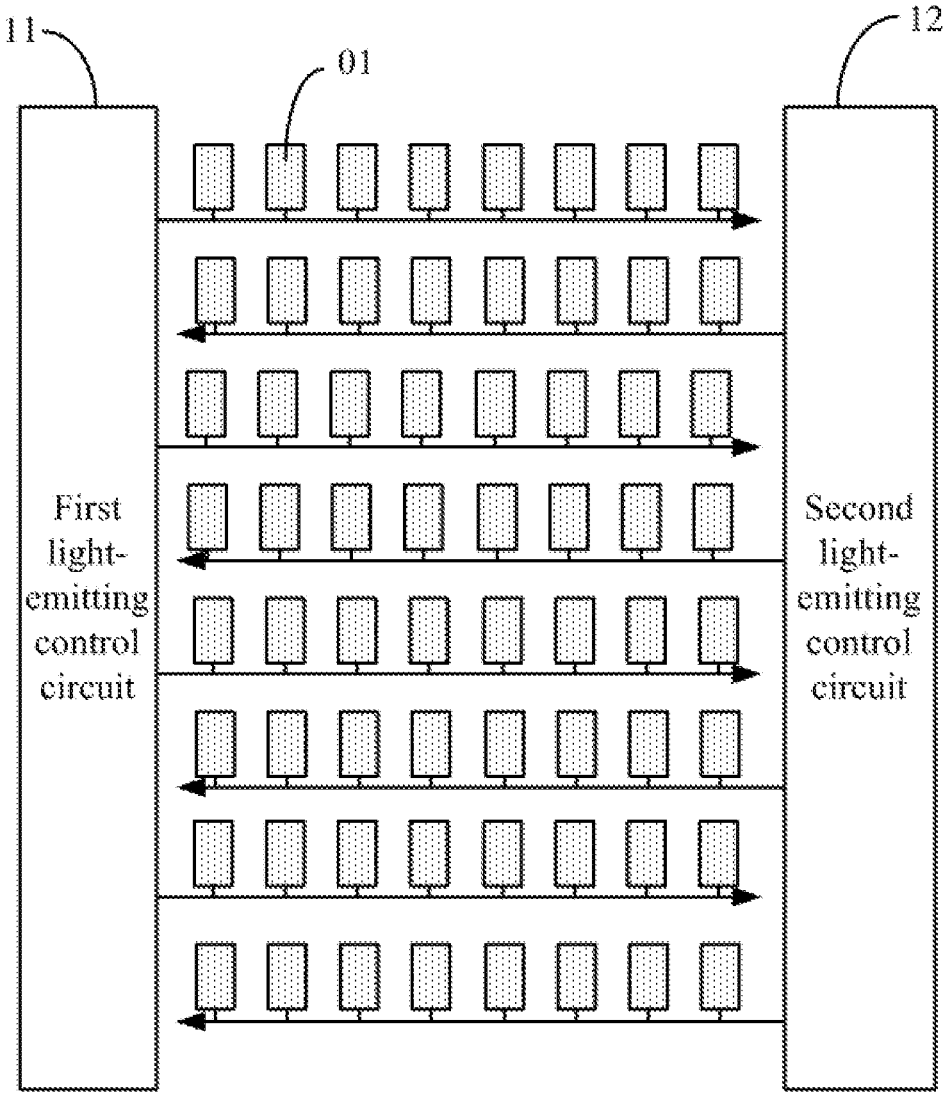
FIG. 12 is a schematic structural diagram of a display panel according to an embodiment of the disclosure.

Specifically, in the display panel according to the embodiment of the disclosure, as illustrated in FIG. 12, the display panel includes two light-emitting control circuits, e.g., a first light-emitting control circuit 11 and a second light-emitting control circuit 12 as illustrated in FIG. 12.

Here the first light-emitting control circuit 11 is configured to provide odd rows of pixels 01 with a light-emitting control signal, and the second light-emitting control circuit 12 is configured to provide even rows of pixels 01 with a light-emitting control signal. So that when a frame of image is displayed, a same light-emitting control signal is transmitted to the odd rows of pixels 01, and a same light-emitting control signal is transmitted to the even rows of pixels 01. Thus the light-emitting control signal transmitted to the odd rows of pixels 01 could be different from the light-emitting control signal transmitted to the even rows of pixels 01.

Figure 13:
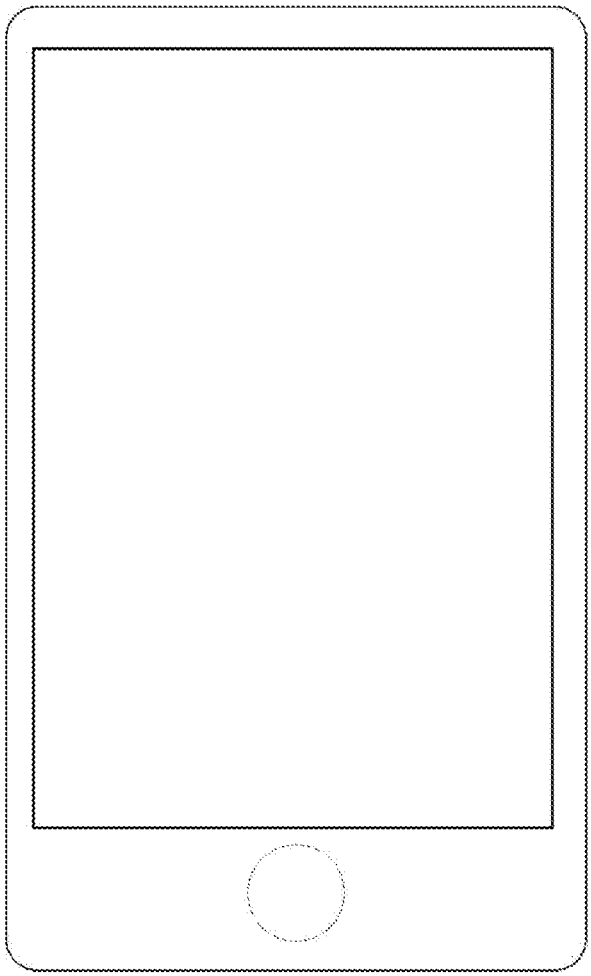
FIG. 13 is a schematic display device according to an embodiment of the disclosure.

Based upon the same inventive idea, an embodiment of the disclosure further provides a display device as illustrated in FIG. 13 which is a schematic structural diagram of the display device according to the embodiment of the disclosure. The display device includes the display panel according to the embodiment above of the disclosure. The display device can be any product or component capable of displaying such as a mobile phone, a tablet computer, a TV set, a display, a notebook computer, a digital photo frame, or a navigator. Reference can be made to the embodiment of the display panel above for an implementation of the display device, so a repeated description thereof is omitted here.

In the display panel, the method for displaying an image on the same and the display device according to the embodiments of the disclosure, for the determined brightness mode, every n frames of images to be displayed are taken as a group, and when being displayed, each group of n frames of images is controlled to emit light for the same total amount of time; and when each frame of image is being displayed each row of pixels operate in the light-emitting phase for the same amount of time, so that the images can be displayed with normal brightness in this mode. When n frames of images in a group are being displayed, different light-emitting control signals are transmitted to the same row of pixels. And/or, when each frame of image in a group is being displayed, at least two different light-emitting control signals are transmitted to different rows of pixels. Different from the prior art in which same light-emitting control signals are used for each row of pixels when displaying different frames of images, and/or, in which a same light-emitting control signal is used for different rows of pixels, the embodiments of the disclosure makes cycles of high and low levels of light-emitting control signals random and solves the problems of poor display performance of existing display panels, such as the existence of bright and dark bands.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

What is claimed is:

1. A display device, comprising a display panel displaying an image on the display panel using a method comprising:

for a brightness mode:

displaying a plurality of groups of n frames each, wherein every group has a same total light-emitting time, wherein a total light-emitting time of each group equals to a sum of light emitting time of all n frames, wherein n is an integer greater than 1;

wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame of image emits light when a row of pixels operate in the light-emitting phase in within one frame;

wherein when n frames of images in a group are displayed, at least two of light-emitting control signals transmitted to a same row of pixels are different.

2. The display device according to claim 1, wherein the display panel comprises two light-emitting control circuits; and one of the light-emitting control circuits is configured to provide odd rows of pixels with a light-emitting control signal, and the other light-emitting control circuit is configured to provide even rows of pixels with a light-emitting control signal.

3. A display panel, displaying an image on the display panel using a method comprising:

for a brightness mode:

displaying a plurality of groups of n frames each, wherein every group has a same total light-emitting time, wherein a total light-emitting time of each group equals to a sum of light emitting time of all n frames, wherein n is an integer greater than 1;

wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame;

wherein when n frames of images in a group are displayed, at least two of light-emitting control signals transmitted to a same row of pixels are different.

4. The display panel according to claim 3, wherein the display panel comprises two light-emitting control circuits; and wherein one of the light-emitting control circuits is configured to provide odd rows of pixels with a light-emitting control signal, and wherein the other light-emitting control circuit is configured to provide even rows of pixels with a light-emitting control signal.

5. A method for displaying an image on a display panel, comprising:

for a brightness mode:

displaying a plurality of groups of n frames each, wherein every group has a same total light-emitting time, wherein a total light-emitting time of each group equals to a sum of light emitting time of all n frames, wherein n is an integer greater than 1;

wherein when displaying each frame of image, transmitting a light-emitting control signal having at least one pulse cycle to each row of pixels in the display panel, wherein the pulse cycle comprises a light-emitting phase and a closing phase, each row of pixels operate in the light-emitting phase for a same amount of time, and wherein a frame of image emits light when a row of pixels operate in the light-emitting phase in within one frame;

wherein when n frames of images in a group are displayed, at least two of light-emitting control signals transmitted to a same row of pixels are different.

6. The method according to claim 5, wherein when one frame of image in a group is displayed, at least two of light-emitting control signals transmitted to two rows of pixels are different.

7. The method according to claim 5, wherein when different frames of images in a same group are displayed, light-emitting control signals transmitted to a same row of pixels are in the light-emitting phase for a same amount of time; and wherein when each frame of image in a group is displayed, at least two of light-emitting control signals transmitted to different rows of pixels are different.

8. The method according to claim 7, further comprising wherein when any two adjacent frames of images in a same group are displayed, light-emitting control signals transmitted to a same row of pixels comprise different numbers of pulse cycles, wherein each of the pulse cycles has a same duty cycle; and wherein when each frame of image in a group is displayed, at least two of light-emitting control signals transmitted to different rows of pixels are different.

9. The method according to claim 6, further comprising:

at least two light-emitting control signals transmitted to the two rows of pixels have different numbers of pulse cycles.

10. The method according to claim 9, further comprising transmitting light-emitting control signals having a same number of pulse cycles to all odd rows of pixels and transmitting light-emitting control signals having a same number of pulse cycles to all even rows of pixels; and wherein:

the number of pulse cycles in one of the light-emitting control signals transmitted to all the odd rows of pixels is different from the number of pulse cycles in one of the light-emitting control signals transmitted to all the even rows of pixels.

11. The method according to claim 5, wherein when different frames of images in a same group are displayed, light-emitting control signals transmitted to a same row of pixels are in the light-emitting phase for a same amount of time;

wherein a light-emitting control signal transmitted to a row of pixels for displaying at least one of any two adjacent frames of images in a same group has at least two pulse cycles and at least two duty cycles of the pulse cycles are different.

12. The method according to claim 11, wherein when any two adjacent frames of images in a same group are displayed, light-emitting control signals comprising a same number of pulse cycles are transmitted to a same row of pixels.

13. The method according to claim 5, wherein when different frames of images in a same group are displayed, light-emitting control signals transmitted to a same row of pixels are in the light-emitting phase for different amounts of time.

14. The method according to claim 13, wherein when any two adjacent frames of images in a same group are displayed, light-emitting control signals transmitted to a same row of pixels are in the light-emitting phase for different amounts of time.

15. The method according to claim 14, wherein between light-emitting control signals transmitted to a same row of pixels when any two adjacent frames of images in the same group are displayed, duty cycles of pulse cycles in a light-emitting control signal for either said frame of images are the same, and duty cycles of pulse cycles in the light-emitting control signals for different frames of images are different.

16. The method according to claim 15, wherein when any two adjacent frames of images in the same group are displayed, the numbers of pulse cycles included in light-emitting control signals transmitted to a same row of pixels are the same.

17. The method according to claim 14, wherein when a frame of image in a group is displayed, a light-emitting control signal transmitted to at least one row of pixels comprises at least two pulse cycles and duty cycles of at least two of the pulse cycles are different.

18. The method according to claim 11, wherein when each frame of image in a group is displayed, the light-emitting control signals transmitted to different rows of pixels are the same.

19. The method according to claim 13, wherein when each frame of image in a group is displayed, a same light-emitting control signal is transmitted to different rows of pixels.

20. The method according to claim 8, wherein at least two light-emitting control signals transmitted to the different rows of pixels have different numbers of pulse cycles.

* * * * *